United States Patent [19]

Bruns

[11] 4,364,690

[45] Dec. 21, 1982

[54] METHODS OF SETTING ROADMAKING MATERIAL AND SMOOTHING SCREEDS FOR PERFORMING SUCH METHODS

[75] Inventor: Theodor Bruns, Jeddeloh, Fed. Rep. of Germany

[73] Assignee: Maschinenfabrik Klaus-Gerd Hoes, Wardenburg-Westerholt, Fed. Rep. of Germany

[21] Appl. No.: 963,598

[22] Filed: Nov. 24, 1978

[30] Foreign Application Priority Data

May 31, 1978 [DE] Fed. Rep. of Germany ..... 2823727

[51] Int. Cl.[3] ..... E01C 19/22

[52] U.S. Cl. ..... 404/118

[58] Field of Search ..... 404/118, 119, 120, 114, 404/96, 97, 104, 103

[56] References Cited

U.S. PATENT DOCUMENTS

| | | | |
|---|---|---|---|
| 413,846 | 10/1889 | Chambers | 404/119 |
| 1,390,479 | 9/1921 | Baker | 404/96 |
| 1,662,257 | 3/1928 | Valerio | 404/104 X |
| 1,768,663 | 7/1930 | Carr | 404/96 X |
| 1,833,546 | 11/1931 | Wight | 404/119 |
| 2,039,026 | 4/1936 | Pease | 404/75 |
| 2,094,910 | 10/1937 | Baily | 404/96 |
| 2,333,041 | 10/1943 | Poulter | 404/103 X |
| 2,412,398 | 12/1946 | Harsch | 404/114 X |
| 2,599,330 | 6/1952 | Jackson | 404/114 |
| 2,948,202 | 8/1960 | Millikin | 404/119 |
| 3,559,543 | 2/1969 | Schwoebel | 404/118 X |
| 3,559,544 | 2/1971 | Miller | 404/96 |
| 3,625,121 | 12/1971 | Blumer | 404/96 |
| 3,680,451 | 8/1972 | Birtchet | 404/104 |

FOREIGN PATENT DOCUMENTS

| | | | |
|---|---|---|---|
| 831023 | 5/1938 | France | 404/114 |

*Primary Examiner*—Nile C. Byers, Jr.

*Attorney, Agent, or Firm*—Allison C. Collard; Thomas M. Galgano

[57] ABSTRACT

A smoothing screed is used with a road finishing machine for setting roadmaking material when the surface of a road pavement, which has been damaged by tracks or depressions worn therein, is renewed. The smoothing screed is of adjustable width and profile and has a central main screed from which adjusting screeds may be drawn out laterally. There is further provided a central ridge profile adjustment device, which allows the central portion of the main screed to be adjusted so as to be lower than the ends of the main screed, and two further adjustment devices at the ends of the main screed, which allow the outer ends of the adjusting screeds to be adjusted so as to be lower than the ends of the main screed.

2 Claims, 1 Drawing Figure

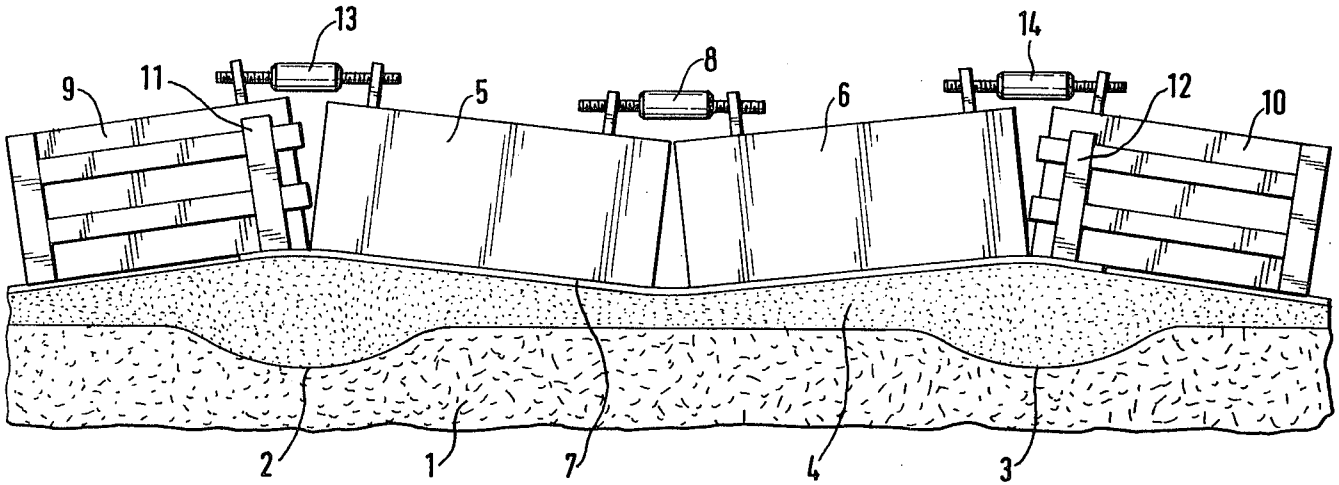
10
12
14
6
8
5
13
11
9
3
4
7
1
2

METHODS OF SETTING ROADMAKING MATERIAL AND SMOOTHING SCREEDS FOR PERFORMING SUCH METHODS

The invention relates to a method of setting roadmaking material when renewing the surface of a road pavement, which has been damaged by tracks or depressions worn therein, by means of a road finishing machine which has a smoothing screed of adjustable working width and ridge profile.

The thickness of a layer of a newly applied road surface increases in the area where tracks or depressions have been worn. After being applied, the building material is smoothed and compacted. Compaction takes place in proportion to the thickness of the layer applied. In the case of compaction of 10% for example a 10 cm thick layer of roadmaking material is compacted to 9 cm. Where depressions have been worn the thickness of the layer can amount to 15 cm for example, so that, in contrast to the adjacent areas of the road surface, compaction to 13.5 cm takes place. In this way, after compaction, a depression with a depth of 0.5 cm will still remain in the road surface, in which water will accumulate when it rains, which can lead to aquaplaning of vehicles.

In order to ensure that rainwater runs off, the section of the road is made slightly convex. The apex of the curve may be made by laying the building material thicker in the middle of the road surface. This is carried out with known road finishing machines by adjusting the smoothing screed or compacting screed to form a positive ridge profile, the sides of the screed being pushed downwards with respect to the middle.

According to one aspect of the invention there is provided a method of setting roadmaking material when renewing the surface of a road pavement, which has been damaged by tracks or depressions worn therein, by means of a road finishing machine which has a smoothing screed of adjustable working width and ridge profile, the method comprising adjusting the smoothing screed to form a negative ridge profile so as to form a depression of the road surface in use, and bending each of the free ends of the smoothing screed, from which adjusting screeds arranged to vary the working width are arranged to be drawn out, so as to form a raised portion of the road surface in use.

In this way an undulating shape is produced in the full-width lower smoothing plate of the screed, and, together with the adjusting screeds which may be drawn out laterally, the thickness of the layer of the material to be set is increased in the area of the parallel depressions, which lie beneath the apices of the positive curves of the screed.

The curves of the sections of the screed may be precisely adjusted, so that, in one operation of the road finishing machine, it is possible to eliminate worn depressions completely since, on account of the positive curves of the screed, there is so much additional building material beneath the screed in the area of the depressions that complete compensation of the different degrees of compaction is attained.

According to another aspect of the invention there is provided a smoothing screed for performing the method of the invention, comprising a central main screed from which adjusting screeds are arranged to be drawn out laterally, the main screed having a centrally disposed ridge-profile adjustment device and two further similar adjustment devices disposed at respective free ends of the main screed.

The adjustment device permits the screed to be bent positively and negatively as required, so that the screed no longer sets a uniform thickness of the layer but permits the thickness of the layer to be increased at the apex of the curves.

The main screed preferably comprises four sections separate from one another and disposed together on a common smoothing plate. The smoothing plate is bent as the individual sections are inclined with respect to one another as required.

Adjusting screws which are known per se have proved successful as adjustment devices. They may also be used in the screed for inclining the individual sections of the main screed towards one another or pushing them away from one another, thereby bending the smoothing plate.

Each adjustment device may be associated with a measuring device known per se which in a preferred embodiment comprises a scale and a pointer which are disposed in the area of the separation lines between adjacent sections of the main screed. Each of the adjacent sections bears a scale, while the other section bears the associated pointer so that deviations from the parallel alignment of the separating edges of the sections may be indicated on the scale.

The invention will be further described, by way of example, with reference to the accompanying drawing, which illustrates diagrammatically a preferred embodiment.

The accompanying drawing shows a section through a road 1 with worn depressions 2 and 3, on which a new surface 4 has been applied by a road finishing machine, the said surface 4 being smoothed with a preferred smoothing screed. The section of the new road surface 4 produced by the smoothing screed is levelled by consecutive rollers which effect the compaction, so that a smooth uniform surface to the road is produced as required.

The smoothing screed comprises a central main screed with two sections 5 and 6, which, although they are separated from one another in the middle, are disposed on a common smoothing plate 7. In order to adjust the ridge profile, the sections may be inclined with respect to one another by means of adjusting screws 8, thereby bending the smoothing plate 7. Tightening the screw has the effect of bending the smoothing plate into a negative ridge section i.e. so as to form a depression in the road surface, as is shown diagrammatically in the drawing. The angles of the curve have been shown greatly exaggerated for the sake of clarity.

Adjusting screeds 9 and 10, which may be drawn out laterally and are used to vary the working width of the smoothing screed, are disposed on the main screed. Only the guide elements for the lateral extension of the adjusting screeds are shown and they require no further explanation. The parts which guide the adjusting screeds on the main screed, for example the vertical supports 11 and 12, are disposed on the smoothing plate 7 of the main screed and may likewise be forced apart by means of additional adjustment screws 13 and 14 as in the manner of the central ridge-profile adjustment, so that positive lateral bending of the smoothing plate takes place i.e. so as to form a raised portion, as shown in the drawing. Since the track widths of motor vehicles are internationally standardized, depressions worn in the road surface 1 are usually at a distance of 1.70 m from one another, and the main screed may therefore be made uniform in such a way that the lateral positive curves of the common smoothing plate 7 are also at a distance of 1.70 m from one another, so that maximum accumulation of building material always occurs at the deepest point of the worn depression.

The distance measurement named above is of course not limited to 1.70 m; in fact it is also possible to make the distance between the curves variable.

What is claimed is:

1. A method of setting roadmaking material when renewing the surface of a road pavement, which has been damaged by track or depressions worn therein by means of a road finishing machine which has a smoothing screed of adjustable working width and ridge profile, said method comprising the steps of:

adjusting said smoothing screed to provide it with a negative ridge profile; and bending back positively each of the free ends of said smoothing screed, from which free ends adjusting screeds for varying said working width may be drawn out;

whereby said smoothing screed sets said roadmaking material with two portions of increased depth corresponding to said positively bent-back free ends.

2. A smoothing screed for use with a road finishing machine in setting roadmaking material when renewing the surface of a road pavement, which has been damaged by tracks or depressions worn therein, comprising:

a central main screed having at least two screed sections each having an inner and outer lateral end, said screed sections being spaced-apart and being disposed laterally side by side with respect to one another with the inner lateral ends thereof disposed adjacent to one another;

a common smoothing plate having a central section and two lateral ends, on which said two screed sections are disposed;

a ridge profile adjustment device including an adjusting screw pivotably coupling said two screed sections together in the area adjacent to their inner lateral ends so as to permit said sections to be moved to an inclined position relative to one another and to, in turn, permit lateral bending of said common smoothing plate into a generally concave, depressed, negative ridge profile in the center section thereof;

two adjusting screeds, each of which is mounted for lateral movement between a retracted and withdrawn position relative to the outer lateral end of one of said screed sections so as to vary the working width of said smoothing screed, each of said adjusting screeds being at least partially disposed on said common smoothing plate; and two supplementary ridge profile adjustment devices, each of which include an adjusting screw, which are each disposed adjacent to an opposite outer lateral end of said screed sections for pivotably coupling said adjusting screeds to said screed sections so as to permit said screed sections and adjusting screeds to be moved to an inclined position relative to one another and to, in turn, permit lateral bending of said smoothing plate into a generally convex, raised, positive profile adjacent the lateral ends thereof.

* * * * *